US007294012B2

(12) United States Patent
AbuGhazaleh et al.

(10) Patent No.: US 7,294,012 B2
(45) Date of Patent: Nov. 13, 2007

(54) COMMUNICATION CONNECTOR TO OPTIMIZE CROSSTALK

(75) Inventors: Shadi A. AbuGhazaleh, Gales Ferry, CT (US); Rehan Mahmood, Lebanon, CT (US); Jeffrey A. Poulsen, Bozrah, CT (US); Rance S. Rust, Waterford, CT (US); Nathaniel L. Herring, Norwich, CT (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 11/598,192

(22) Filed: Nov. 13, 2006

(65) Prior Publication Data

US 2007/0105426 A1 May 10, 2007

Related U.S. Application Data

(62) Division of application No. 10/753,770, filed on Jan. 9, 2004, now Pat. No. 7,223,112.

(51) Int. Cl.
*H01R 4/24* (2006.01)

(52) U.S. Cl. ..... 439/418

(58) Field of Classification Search ..... 439/676, 439/418, 606, 607, 610, 553, 939, 344, 544, 439/604, 354; 29/883
See application file for complete search history.

(56) References Cited

U.S. PATENT DOCUMENTS 4,769,906 A 9/1988 Purpura et al.
5,334,044 A 8/1994 Falossi
5,462,457 A 10/1995 Schroepfer
5,494,457 A 2/1996 Kunz
5,579,425 A 11/1996 Lampert
5,600,885 A 2/1997 Schroepfer et al.
5,620,335 A 4/1997 Siemon
5,993,236 A 11/1999 Vanderhoof
6,071,141 A 6/2000 Semmeling
6,099,345 A 8/2000 Milner
6,238,235 B1 5/2001 Shavit
6,250,817 B1 6/2001 Lampert
6,250,949 B1 6/2001 Lin
6,322,386 B1 11/2001 Tharp
6,325,660 B1 12/2001 Diaz
6,364,685 B1 4/2002 Manning (Continued)

*Primary Examiner*—Phuong Dinh
(74) *Attorney, Agent, or Firm*—Marcus R. Mickney; Mark S. Bicks; Alfred N. Goodman

(57) ABSTRACT

A connector for a communications system provides desired levels of crosstalk by controlling the positions and lengths of the wires. A plurality of insulation displacement contacts are mounted in slots in the plug housing for movement between retracted positions and inserted positions extending into the internal chamber. A first insert is disposed in the internal chamber. A second insert is partially disposed in the internal chamber and has a front end proximal the first insert rear end. The second insert has first, second, third and fourth channels extending from the rear end to the front end of the second insert. Four pairs of wires extend from a cable sheath and pass through one of the first, second, third and fourth channels of the second insert and through a first passageway in the first insert to the insulation displacement contacts in an internal chamber of the connector.

7 Claims, 6 Drawing Sheets

U.S. PATENT DOCUMENTS 6,371,793 B1 4/2002 Doorhy
6,402,559 B1 6/2002 Marowsky
6,431,904 B1 8/2002 Berelsman
6,439,920 B1 8/2002 Chen
6,506,077 B2 1/2003 Nagel
6,524,128 B2 2/2003 Marowsky
6,554,646 B1 4/2003 Casey
6,558,204 B1 5/2003 Weatherley
6,561,838 B1 5/2003 Blichfeldt
6,860,750 B1 3/2005 Wu
2002/0142644 A1 10/2002 Aekins
2003/0096529 A1 5/2003 Brennan et al.
2003/0199192 A1 10/2003 Caveney et al.

COMMUNICATION CONNECTOR TO OPTIMIZE CROSSTALK

CROSS REFERENCE TO RELATED APPLICATION

This application is a division of U.S. patent application Ser. No. 10/753,770, filed Jan. 9, 2004 now U.S. Pat. No. 7,223,112.

FIELD OF THE INVENTION

The present invention relates to a communication connector having first and second inserts in a plug housing to achieve the required levels of crosstalk. More particularly, the present invention relates to a communication connector having a second insert that abuts a cable sheath to control wire length between a cable sheath and the first insert, as well as maintaining wire separation and twist present in the cable sheath. Still more particularly, the present invention relates to a communication connector having an overmold to control crosstalk and to provide strain relief.

BACKGROUND OF THE INVENTION

In telecommunication systems, signals are transmitted over cables having balanced twisted pairs of wires. Typical cables have four pairs of twisted wires in them. For connecting wires to other cables or to other apparatus, connectors are mounted on the ends of the cables. Although connectors can be mounted in the field after the cables and wires therein are cut to the appropriate length for the particular installation, preferably, high performance connectors are preferably assembled in a controlled environment so they can be tested and qualified for use.

Due to advances in telecommunications and data transmissions, connectors, particularly including plugs, have become a critical impediment to good performance of data transmission at new, higher frequencies. Some performance characteristics, particularly near end crosstalk and return loss, degrade beyond acceptable levels at these higher frequencies.

One way to overcome this crosstalk problem is to increase the spacing between the signal lines. Another method is to shield the individual signal lines. However, in many cases, the wiring is pre-existing and standards define geometries and pin definitions for connectors making such changes to those systems is cost prohibitive. In this specific situation of communications systems, using unshielded twisted pair wiring cables is the only practical alternative.

When electrical signals are carried on a signal line or wire which is in close proximity to another signal line or other signal lines, energy from one signal can be coupled onto adjacent signal lines by means of the electric field generated by the potential between the two signal lines and the magnetic field generated as a result of the changing electric fields. This coupling, whether capacitive or inductive, is called crosstalk when the coupling occurs between two or more signal lines. Crosstalk is a noise signal and degrades the signal-to-noise margin (s/n) of a system. In communications systems, reduced s/n margin results in greater error rates in the information conveyed on the signal lines.

Performance requirements for modular plugs are defined in ANSI/TIA/EIA-568-B, "Commercial Building Telecommunications Cabling Standard". In the Category 6 Addendum TIA-568-B.2-1 to that standard, the acceptable performance ranges are detailed in Section E.3.2.2, and summarized in Table E.3.

Additionally, in communications systems certain standards have been developed that define connector geometry and pin out definitions. Those standards were created prior to the need for high speed data communications, and have created a large installed base of wiring connectors. Additionally, those standards have created a need for connectors capable of maintaining the requirements of higher speed communications, while maintaining compatibility with original connectors.

The standard connector geometry and pin outs can generate a great deal of crosstalk at higher signal frequencies. Connectors addressing this problem include U.S. Pat. No. 5,432,484 to Klas et al and U.S. Pat. No. 5,414,393 to Rose et al, the subject matters of which are hereby incorporated by reference in their entirety.

U.S. Pat. No. 6,080,007 to Milner et al., and which is hereby incorporated by reference in its entirety, discloses a connector for a communications system. However, the rear sled 34 (FIG. 4) provides individual conduits for each wire passing therethrough. Additionally, the rear end of the rear sled is flush with the rear end of the plug housing, so that it cannot control the distance between the cable sheath and the rear sled.

U.S. Pat. No. 6,439,920 to Chen discloses an electronic connector for high speed transmission. The end of the cable sheath 30 (FIG. 3) is spaced from the point at which the wires enter the inserts tunnels 61-64 (FIG. 2) so the insert element restricts the spacing of the wires through the insert element, thereby preventing control of the crosstalk level.

In addition to the crosstalk reduction provided by the inventions of the above cited patents, crosstalk generated at the connection between the cable wires and the connectors, particularly the plug connectors has become significant. Variations in the placement of the wiring creates varying amounts of crosstalk. Additionally, the wires must be accurately and precisely located within the connector to facilitate termination by the insulation displacement contacts.

Thus, there is a continuing need to provide improved connectors for communications systems.

SUMMARY OF THE INVENTION

Accordingly, it is a primary objective of the present invention to provide an improved connector for a communications system.

A further objective of the present invention is to provide an improved connector for controlling the crosstalk level.

A still further objective of the present invention is to provide a connector for controlling the distance between the end of the cable sheath and the sled insert of the connector.

Still another objective of the present invention is to provide a connector for maintaining the separation and twist of the wires in the cable sheath between the cable sheath and the sled insert.

Another objective of the present invention is to provide a connector with an overmold to further control crosstalk levels and to provide strain relief for the cable.

The foregoing objectives are basically attained by a connector for a communications system that provides desired levels of crosstalk by controlling the positions and lengths of the wires, and a kit and method for forming the connector. The connector has a plug housing having front and rear ends. An internal chamber opens on the rear end of the plug housing and is defined by housing walls. A plurality of slots extend through one of the housing walls adjacent the front end and into the internal chamber. A plurality of insulation displacement contacts are mounted in the slots for movement between retracted positions spaced from the internal chamber and inserted positions extending into the internal chamber. A first insert is disposed in the internal chamber. The first insert has a front end proximal the front end of the plug housing. A first passageway extends from the front end of the first insert to the rear end of the first insert. A plurality of openings in a first insert wall adjacent the front end are aligned with the plurality of slots in the plug housing and extend into the first passageway. A second insert is partially disposed in the internal chamber and has a front end proximal the first insert rear end. The second insert has first, second, third and fourth channels extending from the rear end to the front end of the second insert. Four pairs of wires extend from a cable sheath. Each pair of wires pass through one of the first, second, third and fourth channels of the second insert and through the first passageway to the insulation displacement contacts in the internal chamber. The first and second inserts control the positioning and the length of the wires between the cable sheath and the insulation displacement contacts in the plug housing, thereby controlling the crosstalk levels.

Other objects, advantages and salient features of the invention will become apparent from the following detailed description, which, taken in conjunction with the annexed drawings, discloses a preferred embodiment of the invention.

BRIEF DESCRIPTION OF THE DRAWINGS

Referring now to the drawings that form a part of the original disclosure.

DETAILED DESCRIPTION OF THE INVENTION

Figure 1:
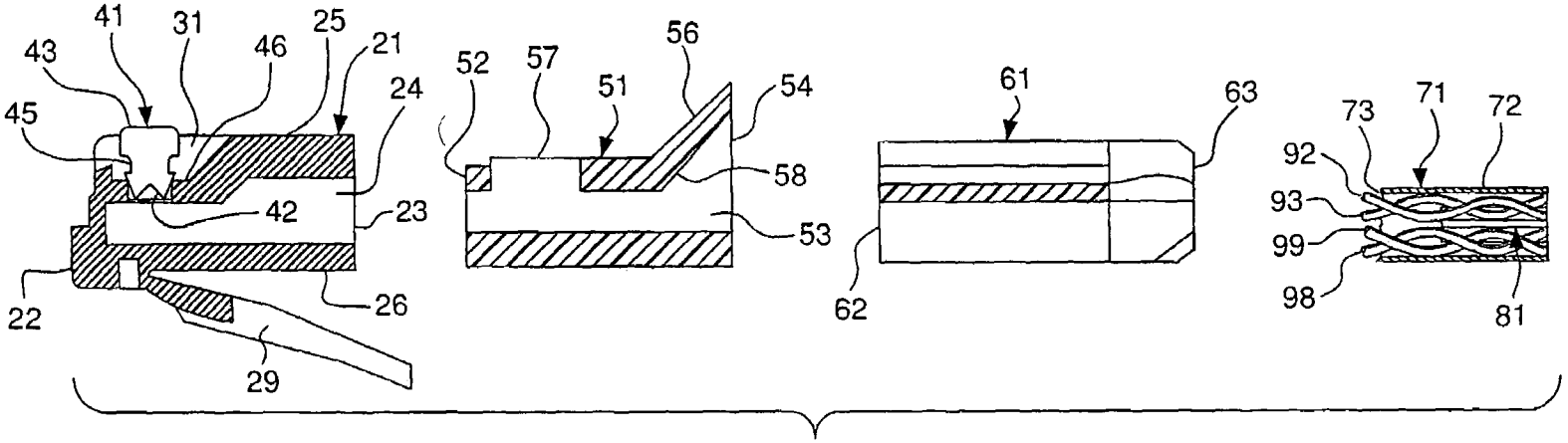
FIG. 1 is an exploded side elevational view in cross section of an disassembled connector for a communications system according to the present invention, with the various parts illustrated in different scales.
Figure 3:
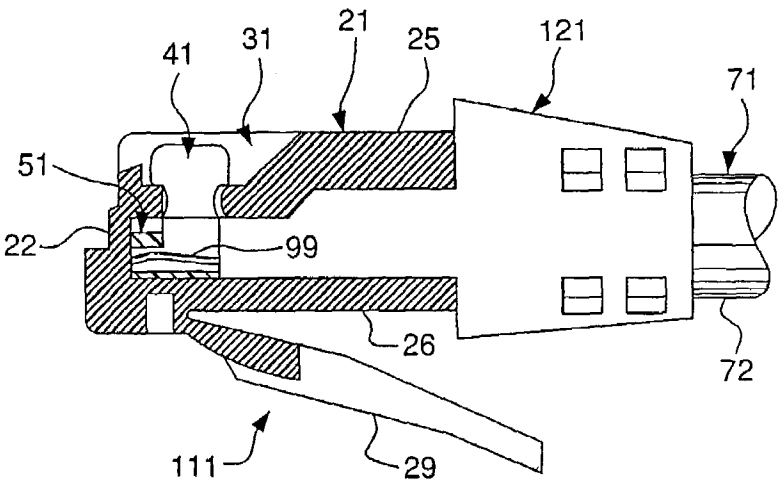
FIG. 3 is a side elevational view in partial cross section of the connector for a communications system of FIG. 1, additionally including an overmold.
Figure 2:
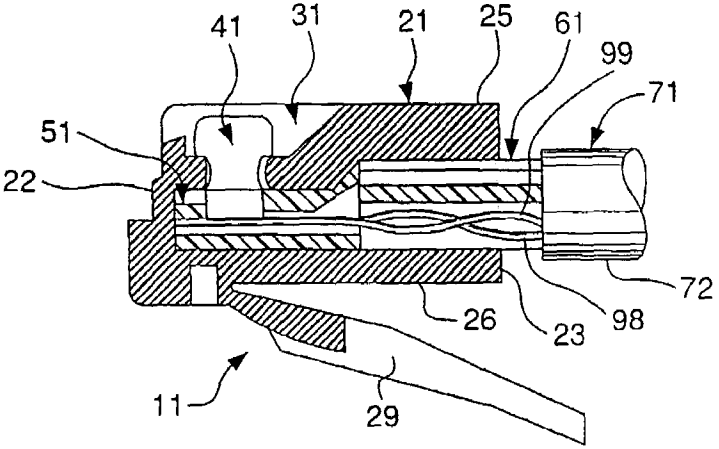
FIG. 2 is a side elevational view in cross section of the assembled connector for a communications system of FIG. 1.

As shown in FIGS. 1-20, the present invention relates to a connector 11 for a communications system. The connector 11 has a plug housing 21 having a front end 22 and a rear end 23. An internal chamber 24 opens on the rear end 23 of the plug housing 21 and is defined by housing walls. A plurality of slots 31 extend through one of the housing walls adjacent the front end 22 and into the internal chamber 24. A plurality of insulation displacement contacts 41 are mounted in the slots 31 for movement between retracted positions spaced from the internal chamber 24 (FIG. 1) and inserted positions extending into the internal chamber (FIGS. 2 and 3).

A first insert 51 is disposed in the internal chamber 24. The first insert 51 has a front end 52 proximal the front end 22 of the plug housing 21. A first passageway 53 extends from the front end 52 of the first insert 51 to the rear end 54 of the first insert. A plurality of openings 57 in a first insert wall adjacent the front end 52 are aligned with the plurality of slots 31 in the plug housing and extend into the first passageway 53.

A second insert 61 is partially disposed in the internal chamber 24 and has a front end 62 proximal the first insert rear end 54. A rear end 63 of the second insert 61 extends beyond the plug housing rear end 23. The second insert 61 has first, second, third and fourth channels 65-68 (FIGS. 13-15) extending from the front end 62 to the rear end 63 of the second insert.

Cable 71 carries four pairs of wires that extend from an end 73 of a cable sheath 72. Each pair of wires pass through one of the first, second, third and fourth channels 64-67 of the second insert 61 and through the first passageway 53 to the insulation displacement contacts 41 in the internal chamber 24. The first and second inserts 51 and 61 control the positioning and the length of the wires between the end 72 of the cable sheath 71 and the insulation displacement contacts 41 in the plug housing 21, thereby controlling the crosstalk levels.

Figure 4:
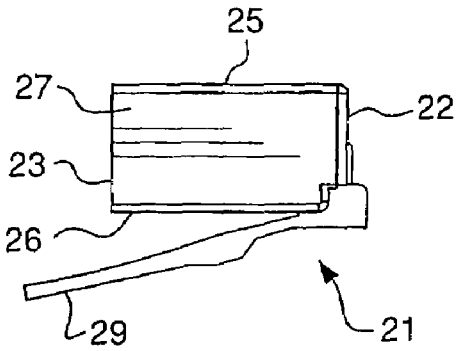
FIG. 4 is a side elevational view of a plug housing.
Figure 5:
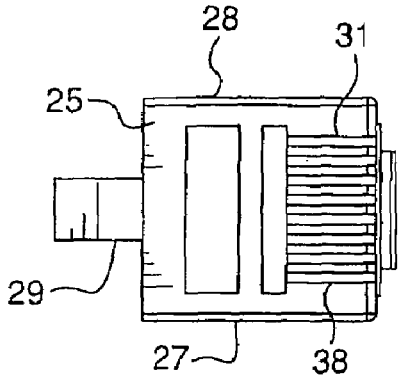
FIG. 5 is a top plan view of the plug housing of FIG. 4.
Figure 6:
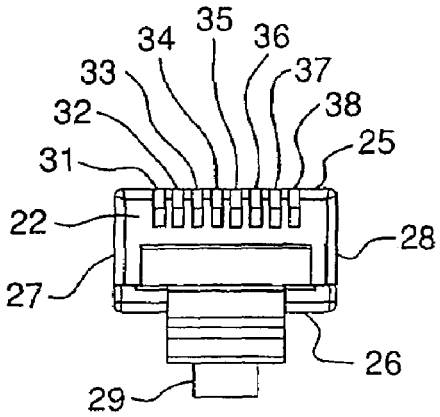
FIG. 6 is a front elevational view of the plug housing of FIG. 4.

The plug housing 21 has a front end 22 and a rear end 23, as shown in FIGS. 4-6. An internal chamber 24 opens on the rear end 23 of the housing 21 and is defined by housing walls. The front and rear ends 22 and 23 of the plug housing 21 are connected by a top wall 25, a bottom wall 26, and side walls 27 and 28. A plurality of slots 31 extend through one of the housing walls adjacent the front end 22 and into the internal chamber 24. Preferably, the slots 31 are in the top wall 25 of the plug housing 21 and extend downwardly into the internal chamber 24, as shown in FIG. 1. Preferably, there are eight slots 31-38 (FIGS. 5 and 6). A conventional latch 29 is connected to the housing to facilitate inserting and removing the plug housing from a receptacle, such as a jack (not shown). Preferably, the latch 29 extends rearwardly beyond the rear end 23 of the plug housing 21, as shown in FIGS. 1-5. Preferably, the plug is an RJ45 type plug. Preferably, the plug housing 21 is a short housing that is approximately half the length of a standard RJ45 plug housing.

Figure 7:
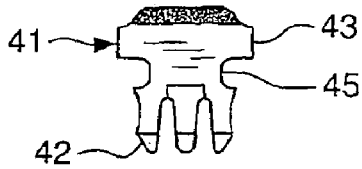
FIG. 7 is a side elevational view of an insulation displacement contact.

The plurality of insulation displacement contacts 41 are mounted in the slots 31 for movement between retracted positions (FIG. 1) spaced from the internal chamber 24 and inserted positions (FIGS. 2 and 3) extending into the internal chamber. Preferably, each slot 31 of the plug housing 21 receives an insulation displacement contact 41. Each insulation displacement contact 41 has a head end 43, a toothed end 42 and a connecting portion 45, as shown in FIG. 7. Prior to assembly, each contact is in the retracted position, as shown in FIG. 1, with toothed end 42 out of the internal chamber 24. After the cable wires mounted in the first inserts 51 are inserted within the internal chamber 24 of the plug housing 21, each of the contacts 31 may be moved to its inserted position downwardly such that the toothed end 42 engages and makes mechanical and electrical contact with the conductors in the insulated wires, as shown in FIGS. 2 and 3. In the inserted position, the lower section of head end 43 engages shoulder 46 of the plug housing. The toothed end 42 of each insulation displacement contact may have any number of teeth to penetrate the wires positioned beneath the slots 31, such as the two-tooth version shown in FIG. 1 or the three-tooth version shown in FIG. 7.

Figure 10:
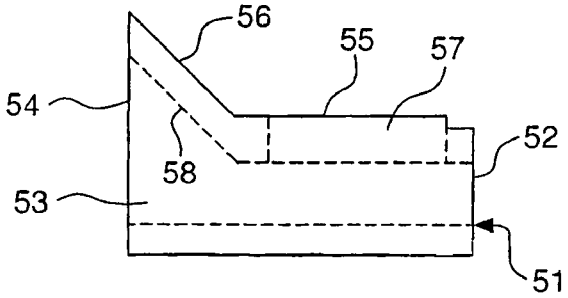
FIG. 10 is a side elevational view of the sled insert of FIG. 9.
Figure 11:
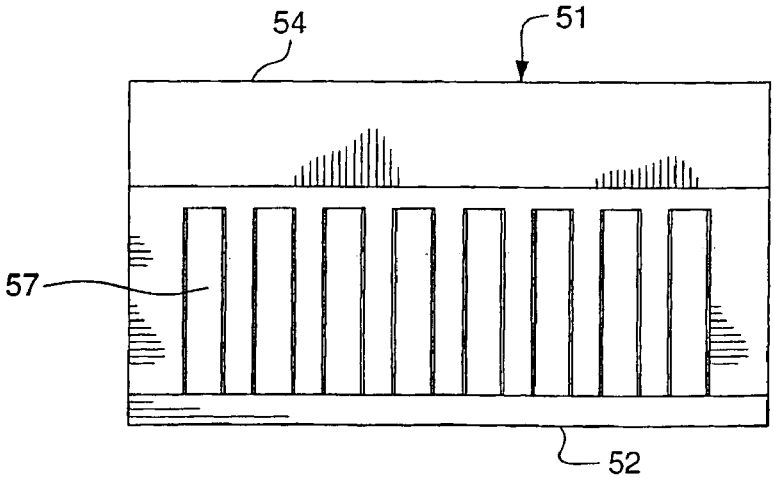
FIG. 11 is a top plan view of the sled insert of FIG. 9.
Figure 12:
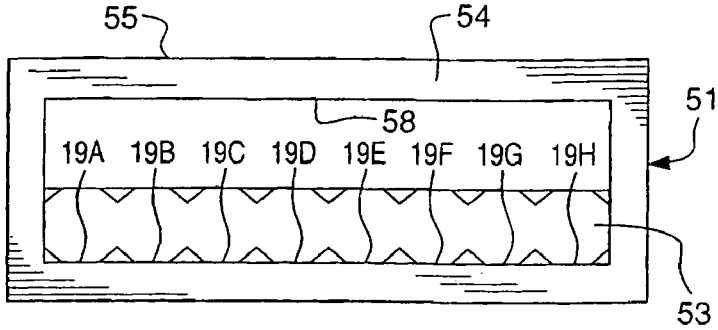
FIG. 12 is a front elevational view of the sled insert of FIG. 9.
Figure 13:
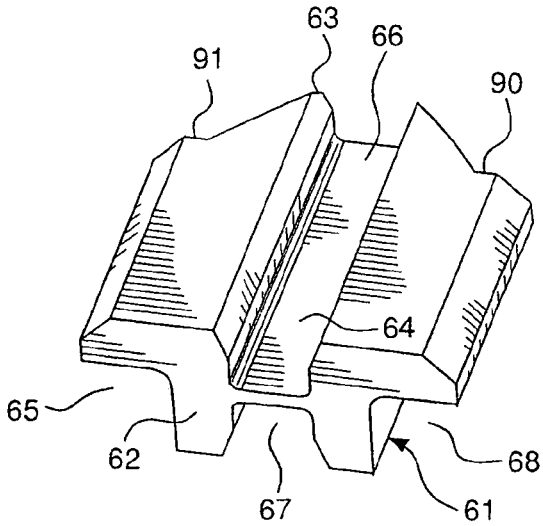
FIG. 13 is a perspective view of the wire manager insert for a plug housing.
Figure 14:
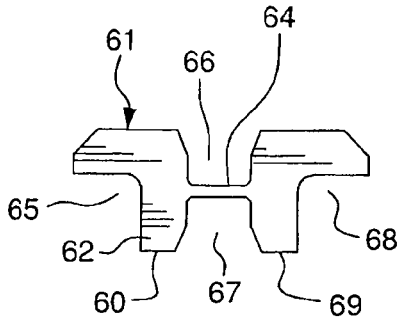
FIG. 14 is a front elevational view of the wire manager insert of FIG. 13.
Figure 15:
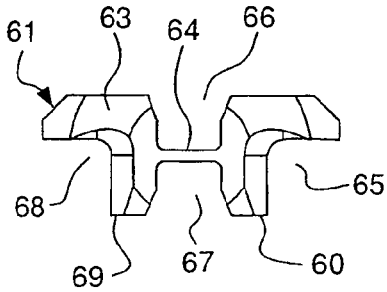
FIG. 15 is a rear elevational view of the wire manager insert of FIG. 13.

A first insert 51, or sled, as shown in FIGS. 9-12, is disposed in the internal chamber 24 of the plug housing 21. The first insert has a front end 52 that is proximal the front end 22 of the plug housing when fully inserted within the internal chamber 24, as shown in FIGS. 2 and 3. A first passageway 53 extends from the front end 52 of the first insert 51 to the rear end 54. The top wall 55 extends between the front end 52 and the rear end 54. The top wall 55 has a ramped portion 56 proximal the rear end 54 of the first insert. As shown in FIG. 10, the passageway 53 follows the top wall, i.e., the portion of the passageway 53 proximal the rear end 54 is also ramped. The ramped portion 58 of the passageway 53 allows for spaced wires in the second insert to gradually be directed downwardly, so that all wires are in a substantially parallel, substantially coplanar relationship at the front end 52 of the insert 51. A plurality of openings 57 extend from the top wall 55 into the first passageway 53. Preferably, there are eight openings 57 in the first insert to correspond to the eight slots 31 in the plug housing 21. The openings 57 in the first insert top wall 55 adjacent the front end 52 are aligned with the plurality of slots 31 in the plug housing and extend into said first passageway. The passageway 53 is further divided into troughs 19. For an eight-wire plug, there would be eight troughs 19A-19H, as shown in FIG. 12.

Figure 16:
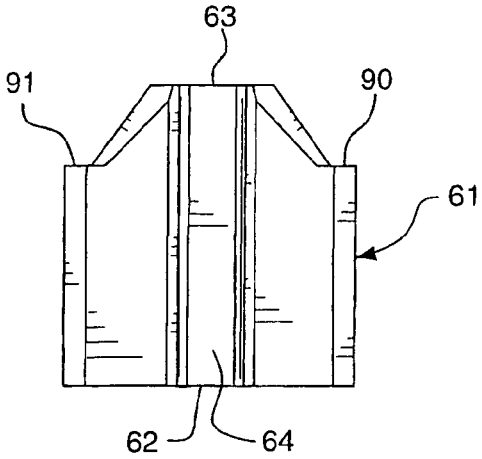
FIG. 16 is a top plan view of the wire manager insert of FIG. 13.
Figure 17:
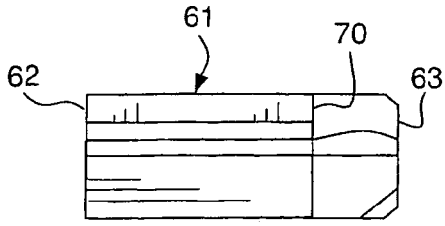
FIG. 17 is a side elevational view of the wire manager insert of FIG. 13.
Figure 21:
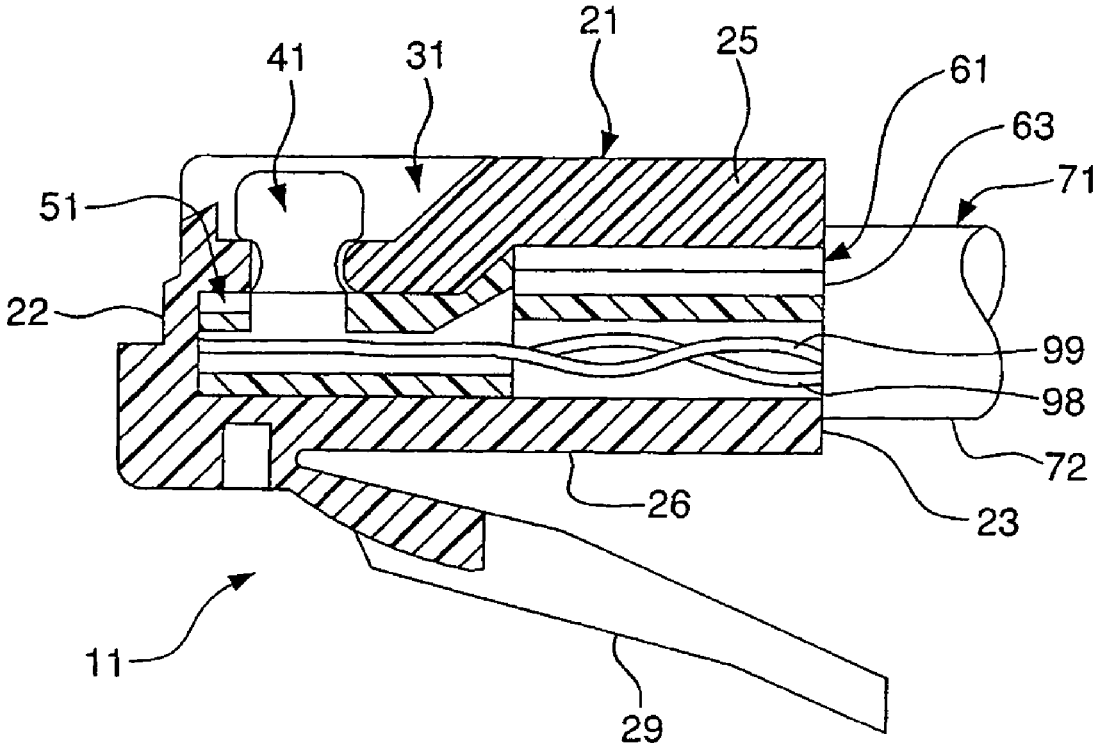
FIG. 21 is a side elevational view in cross section of the assembled connector for a communications system of FIG. 1 according to another exemplary embodiment in which the rear end of the second insert is within the internal chamber of the plug housing.

A second insert 61, or wire spacer, as shown in FIGS. 13-17, is partially disposed within the plug housing internal chamber 24, and has front end 62 proximal the first insert rear end 54. A rear end 63 of the second insert 61 extends beyond the plug housing rear end 23. Alternatively, the rear end 63 of the second insert 61 is within the internal chamber 24 of the plug housing 21, as shown in FIG. 21. The second insert 61 broadly resembles two L-shaped sections 60 and 69 joined by a rib to form four channels 65-68 extending from the front end 62 to the rear end 63. Each of the channels 65-68 is open, i.e., none of the channels are completely enclosed within the second insert 61. Preferably, channels 65 and 68 are the outer channels, with channels 66 and 67 being the inner channels. Inner channels 66 and 67 are located above and below the rib 64, with legs 60 and 69 forming the walls of the channels. Preferably, each channel accommodates a pair of wires therethrough. The spacing of the channels facilitates achieving the desired level of crosstalk in the connector 11. Each leg 60 and 69 has a shoulder 90 and 91, respectively, on the rear end 63 of the second insert 61, as shown in FIG. 16. The legs 60 and 69 taper inwardly toward the rib 64 beyond the shoulders 90 and 91, thereby allowing the rearward portion of the second insert 61 beyond the shoulders to be received within a cable sheath 71, as shown in FIG. 2. The shoulders 90 and 91 allow the second insert 61 to control the distance between the end 73 of the cable sheath 71 and the first insert 51, thereby further facilitating achieving the desired level of crosstalk in the connector 11. Alternatively, the end 73 of the cable sheath 71 abuts the rear end 63 of the second insert 61, i.e., the second insert is not received within the cable sheath, as shown in FIG. 21.

Figure 18:
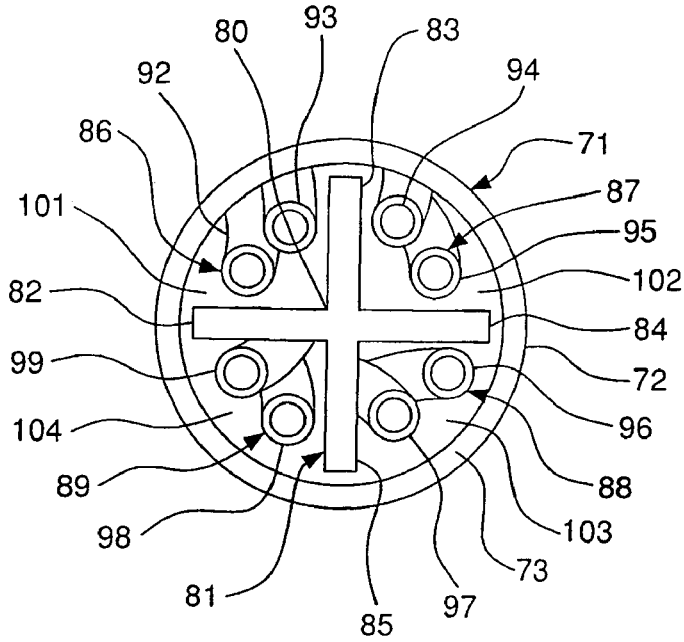
FIG. 18 is a front plan view of the cable showing a wire spacer insert within a cable sheath with four pairs of twisted wires.

A cable 71 carries four pairs 86-89 of wires 92-99 within a cable sheath 72, as shown in FIG. 18. The four pairs of wires extend from an end 73 of the cable sheath. Each pair of wires passes through one of the channels 65-68 of the second insert 61 and through the passageway 53 of the first insert 51 to the insulation displacement contacts 31 in the internal chamber 24 of the plug housing and first insert. The present invention is applicable to a cable carrying any number of pairs of wires.

Figure 8:
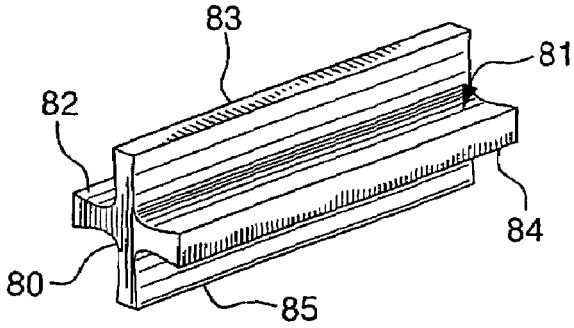
FIG. 8 is a perspective view of a wire spacer insert for a cable sheath.
Figure 9:
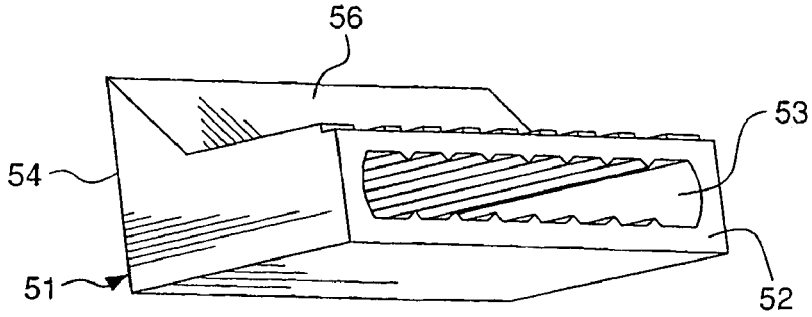
FIG. 9 is a perspective view of a sled insert for a plug housing.

Third insert 81, or wire spacer, as shown in FIGS. 8 and 18, in the cable sheath 71 separates the interior of the cable sheath into four separate sections 101-104. Any suitable wire spacer may be used, such as those disclosed in U.S. Pat. No. 6,250,951 to Milner et al., which is hereby incorporated by reference in its entirety. Alternatively, a wire sheath 71 may be used that is pre-assembled with the third insert extending along the entire length of the cable sheath. Preferably, the third insert 81 is flush with the end 73 of the cable sheath 71, as shown in FIG. 1, thereby facilitating abutting the cable sheath and third insert with the rear end 63 of the second insert 61. Alternatively, the third insert 81 may end within the cable sheath 71 so that the rear end 63 of the second insert 61 abuts the third insert within the cable sheath. Third insert 81 has a central core 80 from which four legs 82-85 extend outwardly toward the cable sheath. Preferably, adjacent legs of the third insert 81 are perpendicular to one another, i.e., leg 82 is perpendicular to each of legs 83 and 85, etc. The legs 82-85 are long enough to prevent wires from passing from one section to another within the cable sheath, but the legs do not have to be long enough to contact the cable sheath. Preferably, the third insert 81 is substantially X-shaped, as shown in FIG. 8, but any suitable configuration may be used to maintain separation of the pairs of wires within the cable sheath 72, such as a substantially H-shaped insert or a planar insert to divide the cable sheath into two sections.

Preferably, the cable 71 carries four pairs of wires, as shown in FIG. 18. First wire pair 86 includes wires 92 and 93 in a first section 101 within the cable sheath 72. Second wire pair 87 includes wires 94 and 95 in a second section 102 within the cable sheath 72. Third wire pair 88 includes wires 96 and 97 in a third section 103 within the cable sheath 72. Fourth wire pair 89 includes wires 98 and 99 in a fourth section within the cable sheath. Preferably, each pair of wires is twisted along the axial length of the cable 71.

Figure 19:
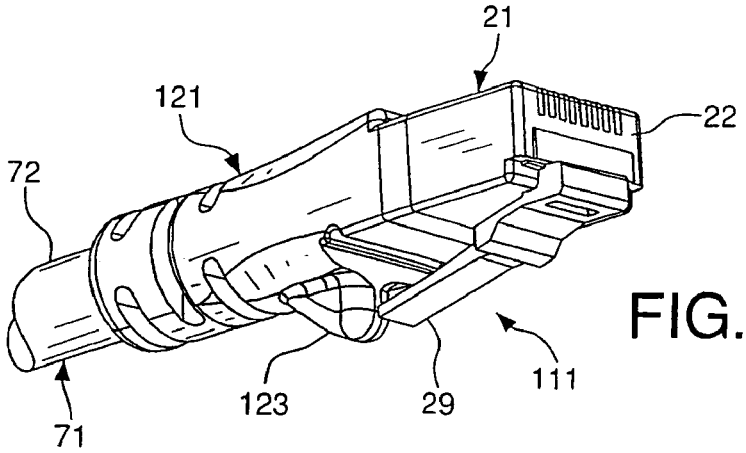
FIG. 19 is a perspective view of a connector having an overmold that has a projection to prevent snagging a latch on the plug housing.
Figure 20:
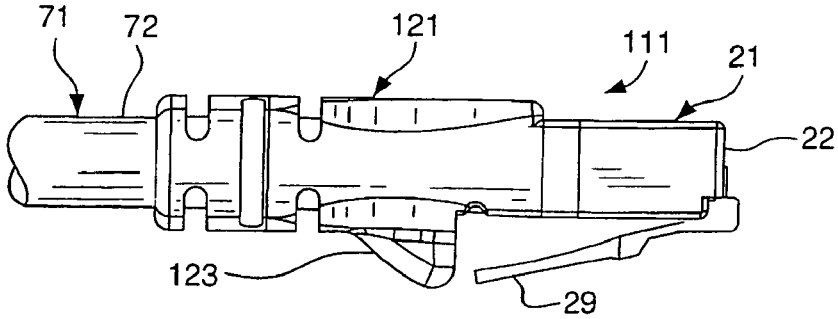
FIG. 20 is a side elevational view of the connector of FIG. 19.

An overmold 121 may be used with the connector 111 according to a second embodiment of the present invention, as shown in FIG. 3. The overmold 121 preferably encompasses a portion of the first insert 51, the second insert 61 and a portion of the cable 71. The overmold 121 is received within the internal chamber 24 of the plug housing 21 and terminates on the cable sheath 72 behind the cable end 73. The overmold 121 provides strain relief to the connector 111, thereby preventing the cable 71 from bending at the rear end 23 of the plug housing 21 and straining the internal components and wires. The overmold 121 also provides a secure connection between the cable sheath 72 and the plug housing 21. Preferably, the overmold 121 is a low temperature, low pressure overmold. As shown in FIGS. 19 and 20, the overmold 121 may have a projection 123 to prevent snagging the latch 29 on other cables, conduits, wires, components or other similar devices that are present in the area as the connector 111 is being pulled rearwardly. The projection 123 allows the connector to be pulled rearwardly without having to worry about snagging the latch and possibly damaging the connector. Preferably, the projection 123 is unitarily formed with the overmold 121, thereby maintaining a narrow profile so that the projection does not unduly enlarge the width of the connector 111.

Preferably, the plug housing, first insert and second insert are made of a non-conductive material, such as a plastic material. Preferably, the plastic material is a dielectric material, such as a polycarbonate material.

ASSEMBLY AND DISASSEMBLY

The connector 11 according to a first embodiment of the present invention is shown unassembled in FIG. 1 and assembled in FIG. 2. The first and second inserts within the internal chamber 24 of the plug housing 21 control the length and positioning of the wires and wire pairs to effectively achieve the desired level of crosstalk in the connector.

Each of the four pairs of twisted wires emerging from the end 73 of the cable sheath 72 are maintained in their paired configuration. Preferably, two of the pairs of wires are untwisted for the length external of the cable sheath. However, these two pairs of wires may range from untwisted through varying degrees of twist external to the cable sheath depending on the desired level of crosstalk. The remaining two pairs of wires are maintained in their twisted configuration. The level of crosstalk is controlled by the degree of twist and shape of the wire pairs.

For example, in a typical Cat. 6 and 6 e patch cord there are four pairs of wires within the cable. A first pair 86 is a twisted blue wire and a blue/white wire. A second pair 87 is a twisted orange wire and orange/white wire. A third pair 88 is a twisted green wire and a green/white wire. A fourth pair 89 is a twisted brown wire and a brown/white wire. The blue and blue/white wire pair and the green and green/white wire pair are untwisted along the length of wire extending beyond the end 73 of the cable sheath 72. The orange and orange/white pair and the brown and brown/white pair are maintained in their twisted configuration along the length of wire extending beyond the end 73 of the cable sheath 72.

Each pair of wires is then inserted into a separate channel 65-68 at the rear end 63 of the second insert 61. Preferably, the wires in the twisted configuration are placed in the outer channels 65 and 68. The wires in the untwisted configuration are placed in the inner channels 66 and 67. The second insert 61 is then slid down the length of the wires until the end 73 of the cable sheath abuts the shoulders 90 and 91 of the second insert. This controls the length of the wires from the end 73 of the cable sheath 72 to the first insert 51. For example, the twisted orange and orange/white wire pair is passed through channel 65. The untwisted green and green/white wire pair are passed through inner upper channel 66. The untwisted blue and blue/white wire pair are passed through inner lower channel 67. The twisted brown and brown/white wire pair are passed through outer channel 68. The two twisted pairs of wires are untwisted beyond the front end 62 of the second insert, but are twisted from the cable end 73 through the second insert 61. Preferably, the outer channels 65 and 68 and the lower inner channel 67 allow the three pairs of wires passing therethrough to be substantially parallel along the axial length of the second insert 61.

The positioning and spacing of the pairs of wires in the second insert controls coupling and crosstalk over the length of the second insert, thereby creating the desired amount of crosstalk. This is particularly facilitated by running the wire pairs in the inner upper and lower channels 66 and 67 in an untwisted manner to introduce the desired level of crosstalk, and by running the wire pairs in the outer channels 65 and 68 in a twisted manner to introduce a lesser amount of crosstalk between these pairs and the other pairs of wires. The dielectric material, length and wall thicknesses of the second insert further facilitate achieving the desired level of inductive and capacitive coupling to achieve the desired level of crosstalk.

The first insert 51 is then slid over the four pairs of wires extending beyond the front end 62 of the second insert so that the wires enter the passageway 51 of the first insert. The ramped portion 58 of the first insert 51 (FIGS. 1 and 12) facilitates bringing the pair of wires extending from the upper inner channel 66 into a substantially parallel, substantially coplanar alignment along the axial length of the first insert before the front end 52 of the first insert. Preferably, the first insert 51 is slid along the wires until the rear end 54 of the first insert substantially abuts the front end 62 of the second insert. The passageway 53 has eight troughs 19A-19H so that each wire may extend through the first insert in its own trough, as shown in FIG. 12. For example, the twisted orange and orange/white wire pair from channel 65 are separated and passed along troughs 19A and 19B of the first insert. The untwisted blue and blue/white wire pair from lower channel 67 are passed along troughs 19C and 19D. The untwisted green and green/white wire pair from inner upper channel 66 are ramped down by ramp portion 58 and passed along troughs 19E and 19F. The twisted brown and brown/white wire pair from outer channel 68 are passed along troughs 19G and 19H.

When the wires 92-99 reach the front end 52 of first insert 51, the wires are substantially linearly, or axially, arranged across the troughs 19A-19H of the front insert, i.e., the wires are substantially coplanar. Any portion of the wires extending beyond the front end 52 of the first insert 51 are cut off at the front end of the first insert. The first insert 51 is then inserted in the internal chamber 24 of the plug housing 21 until the front end 52 of the first insert abuts the front end 22 of the plug housing.

Insulation displacement contacts 41 may then be inserted from the insertion position of FIG. 1 to the engagement position of FIGS. 2 and 3. The insulation displacement contacts are pushed down through slots 31 in the plug housing 21 and through corresponding and aligned openings 57 in the first insert so that each contact engages and penetrates one of the wires, thereby forming a mechanical and electrical connection.

The connector 121 according to a second embodiment of the present invention is shown assembled in FIG. 3. The steps of forming the connector are substantially identical. However, prior to inserting the first insert within the inner chamber of the plug housing an overmold 121 is formed. The overmold is formed around a portion of the first insert 51 rearwardly of the openings 57, the second insert 61 and a portion of the cable 71. The overmold 121 facilitates a secure connection between the cable sheath 72 and the first insert 51, with the second insert 61 sandwiched therebetween. The overmold 121 is preferably a higher dielectric material that further introduces desired levels of coupling between the wire pairs to control crosstalk. The overmold 121 also acts as a strain relief and bend-radius controlling structure.

While advantageous embodiments have been chosen to illustrate the invention, it will be understood by those skilled in the art that various changes and modifications may be made therein without departing from the scope of the invention as defined in the appended claims.

What is claimed is:

1. A method of assembling a plug for a communications systems, comprising the steps of controlling two of four pairs of twisted wires extending from a cable sheath by selecting a degree of twist ranging from untwisted to fully twisted;

passing each pair of the two pairs of twisted wires and the two pairs of controlled wires through a separate channel in a second insert;

untwisting any twisted wires to form four pairs of untwisted wires;

passing each untwisted wire through a trough in a single passageway of a first insert;

inserting the first insert into an internal chamber of a plug housing;

aligning openings in the first insert with slots in the plug housing; and engaging an insulation displacement contact with each wire by inserting the insulation displacement contact through one of the slots in the plug housing and the aligned opening in the first insert.

2. The method of assembling a plug for a communications systems according to claim 1, wherein passing each pair of the two pairs of twisted wires and the two pairs of controlled wires through a channel in a second insert comprises passing the two pairs of controlled wires through inner channels and passing the two pairs of twisted wires through outer channels.

3. The method of assembling a plug for a communications systems according to claim 1, wherein passing each wire through a trough in a passageway of a first insert comprises passing each wire through the trough so that the wires are substantially axially arranged.

4. The method of assembling a plug for a communications systems according to claim 1, further comprising inserting a third insert in the cable sheath to separate an internal passageway of the cable sheath into four sections; and running each pair of the four twisted pairs of wires through one of the four sections within the cable sheath.

5. The method of assembling a plug for a communications systems according to claim 1, further comprising abutting a rear end of the second insert with the cable sheath.

6. The method of assembling a plug for a communications systems according to claim 1, further comprising substantially abutting a rear end of said first insert with a front end of said second insert.

7. The method of assembling a plug for a communications systems according to claim 1, wherein the passageway is a single and uninterrupted passageway.

* * * * *